US009401234B2

(12) United States Patent
Tseng et al.

(10) Patent No.: US 9,401,234 B2
(45) Date of Patent: Jul. 26, 2016

(54) OVER-CURRENT PROTECTION DEVICE

(71) Applicants: Chun Teng Tseng, Sanwan Township, Miaoli County (TW); Cheng Hsiang Chen, Luzhu Township, Taoyuan County (TW); Pin Syuan Li, Hsinchu (TW); Chi Jen Su, New Taipei (TW)

(72) Inventors: Chun Teng Tseng, Sanwan Township, Miaoli County (TW); Cheng Hsiang Chen, Luzhu Township, Taoyuan County (TW); Pin Syuan Li, Hsinchu (TW); Chi Jen Su, New Taipei (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 217 days.

(21) Appl. No.: 14/186,224

(22) Filed: Feb. 21, 2014

(65) Prior Publication Data

US 2014/0285938 A1 Sep. 25, 2014

(30) Foreign Application Priority Data

Mar. 22, 2013 (TW) ..... 102110139 A

(51) Int. Cl.
*H01C 7/02* (2006.01)

(52) U.S. Cl.
CPC ..... *H01C 7/021* (2013.01)

(58) Field of Classification Search
CPC ..... H01C 7/027; H01C 1/1406; H01C 7/02; H01C 7/18; H01C 1/148; H01C 7/13; H01C 7/021; H01C 7/028; H01C 7/126; H01C 13/02; H01C 17/28; H01C 17/281; H01C 1/01; H01C 1/1413; H01C 7/005
USPC ..... 338/20, 25, 22 R
See application file for complete search history.

(56) References Cited

U.S. PATENT DOCUMENTS 6,020,808 A * 2/2000 Hogge ..... H01C 1/1406 338/22 R
6,104,587 A * 8/2000 Banich ..... H01C 1/1406 338/22 R
6,157,289 A * 12/2000 Kojima ..... H01C 7/021 338/22 R
6,377,467 B1 * 4/2002 Chu ..... H01C 1/032 361/704
6,480,094 B1 * 11/2002 Chen ..... H01C 1/1406 338/22 R
6,606,023 B2 * 8/2003 Chiang ..... H01C 1/1406 338/22 R (Continued)

FOREIGN PATENT DOCUMENTS

CN 2575817 Y 9/2003
CN 202736617 U 2/2013

*Primary Examiner* — Kyung Lee
(74) *Attorney, Agent, or Firm* — Egbert Law Offices, PLLC

(57) ABSTRACT

An over-current protection device comprises a PTC device, first and second electrodes, a first welding metal plate and a second welding metal plate. The PTC device comprises a first conductive layer, at second conductive layer and a PTC polymeric material layer laminated therebetween. The first electrode electrically connects to the first conductive layer. The second electrode electrically connects to the second conductive layer and is separated from the first electrode. The first welding metal plate is formed on an upper surface of the device and connects to the first electrode. The second welding metal plate is formed on the upper surface or a lower surface of the device and connects to the second electrode. The first and second welding metal plates are placed at two opposite ends of the strip-like structure, and each of them has a thickness sufficient to withstand spot-welding without significant resultant damage to the PTC device.

2 Claims, 7 Drawing Sheets

(56) References Cited

U.S. PATENT DOCUMENTS 6,665,164 B2 * 12/2003 Chu ..... H01C 1/14 361/106
6,809,626 B2 * 10/2004 Chu ..... H01C 7/02 337/167
6,873,244 B2 * 3/2005 Huang ..... H01C 7/02 338/22 R
7,026,583 B2 * 4/2006 Tu ..... H01C 7/02 219/505
7,609,143 B2 * 10/2009 Huang ..... H01C 1/148 29/619
7,715,164 B2 * 5/2010 Huang ..... H05K 1/0234 361/106
2001/0015688 A1 * 8/2001 Li ..... H01C 7/027 338/22 R
2005/0200447 A1 * 9/2005 Chandler ..... H01C 1/1406 338/25
2007/0057759 A1 * 3/2007 Koyama ..... H01C 1/1406 338/22 R
2010/0134942 A1 * 6/2010 Wang ..... H01C 1/1406 361/93.7
2013/0176654 A1 * 7/2013 Wang ..... H01C 7/02 361/93.7
2013/0176655 A1 * 7/2013 Tseng ..... H01C 1/01 361/93.8
2014/0049357 A1 * 2/2014 Tseng ..... H01C 7/02 338/22 R

* cited by examiner

OVER-CURRENT PROTECTION DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to an over-current protection device, and more particularly to an over-current protection device having positive temperature coefficient (PTC) characteristic. The novel over-current protection device is configured to replace a traditional circuit breaker.

2. Description of Related Art Including Information Disclosed Under 37 CFR 197 and 137 CFR 1.98

In recent years, super-thin portable electronic apparatuses have been increasingly developed, resulting in the demand of lightweight, thin and large capacity batteries. To meet the demand of high voltage and large capacity, a battery may use a large capacity cell or a plurality of cells in parallel and/or series connection. In over-current and over-heat protection to batteries, circuit breakers in response to temperature are usually employed nowadays.

An over-current breaker usually uses bi-metal plates, and the bi-metal plates constitute a normally closed micro-switch. When the breaker has current flowing therein, the bi-metal plates are heated and bent and the bi-metal plates bent more intensively as current increases. If over-current occurs, extremely large current induces over-bending of the bi-metal plates, the micro-switch changes to and sustain in an open state to sever the current. As a result, the breaker prevents the circuit from damage which may be caused by over-current. When the over-current or over-temperature event has gone, the bi-metal plates cool down and return to be of original shapes to rebuild a conductive path.

FIG. 1 shows an appearance of a bi-metal breaker 5. The first metal plate 6 and the second metal plate 7 extend outwardly from the insulating body 8. The first metal plate 6 and the second metal plate 7 in the insulating layer 8 form a normally closed micro-switch, whereas the first metal plate 6 and the second metal plate 7 out of the insulating layer 8 serve as soldering, or welding interfaces.

Although the bi-metal design has been widely used in breakers, the bi-metal plates have to be made by precision machinery and need precision manufacturing techniques. As a result, the bi-metal breakers are usually costly. Therefore, it is highly demanded to generate a breaker with high reliability and stability for safety, and consider how to simplify manufacturing process and obtain low cost.

BRIEF SUMMARY OF THE INVENTION

The present application provides an over-current protection device having PTC characteristic, which is able to be connected to a circuit to be protected by spot-welding directly and to replace a traditional bi-metal breaker. Because precision punching is not needed in the manufacturing process, the manufacturing cost of the over-current protection device can decrease effectively.

In accordance with an aspect of the present application, an over-current protection device in place of a bi-metal breaker is devised. The over-current protection device is a strip-like structure containing an upper surface, a lower surface and four lateral planar surfaces, and comprises a PTC device, a first electrode, a second electrode, a first welding metal plate and a second welding, metal plate. The PTC device comprises a first conductive layer, a second conductive layer and a PTC polymeric material layer laminated therebetween. The first electrode electrically connects to the first conductive layer. The second electrode electrically connects to the second conductive layer and is separated from the first electrode. The first welding metal plate is formed on an upper surface of the device and connects to the first electrode. The second welding, metal plate is formed on the upper surface or a lower surface of the device and connects to the second electrode. The first and second welding, metal plates are placed at two opposite ends of the strip-like structure, and each of the first and second welding metal plates has a thickness sufficient to withstand spot-welding without significant resultant damage to the PTC device.

In an embodiment, the over-current protection device further comprises a first insulating layer disposed on the first conductive layer and a second insulating layer disposed on the second conductive layer.

In an embodiment, the first electrode comprises two first electrode layers respectively disposed on the first insulating layer and the second insulating layer, whereas the second electrode comprises two second electrode layers respectively disposed on the first insulating layer and the second insulating layer.

In an embodiment, the over-current protection device further comprises a first conductive connecting member and a second conductive connecting member. The first conductive connecting member electrically connects the first electrode and the first conductive layer, and the second conductive connecting member electrically connects the second electrode and the second conductive layer.

In accordance with another aspect of the present application, an over-current protection device comprises a substrate, a resistive device, a first welding, metal plate and a second welding metal plate. The resistive device is disposed on the substrate and comprises a PTC device, a first electrode and a second electrode. The PTC device comprises a first conductive layer, a second conductive layer and a PTC polymeric, material layer laminated therebetween. The first electrode electrically connects to the first conductive layer. The second electrode electrically connects to the second conductive layer and is separated from the first electrode. The first welding metal plate is formed at an end on a surface of the substrate and electrically connects to the first electrode. The second welding metal plate is formed at another end on the surface of the substrate and electrically connects to the second electrode. Each of the first and second welding metal plate has a thickness sufficient to withstand spot-welding without significant resultant damage to the PTC device.

In an embodiment, the substrate comprises first, second, third and fourth bonding pads. The first bonding pad is configured to connect to the first welding metal plate, whereas the second bonding pad is configured to connect to the second welding metal plate. The third bonding pad is disposed on the lower surface of the resistive device and configured to connect to the first electrode, whereas the fourth bonding pad is disposed on the lower surface of the resistive device and configured to connect to the second electrode. The first and third bonding pads are electrically connected, and the second and fourth bonding pads are electrically connected.

The over-current protection device of the present application can replace a traditional bi-metal breaker and can be subjected to spot-welding without significant damage. The making of the over-current protection device needs not punching process by precision machine, thereby increasing production yield and efficiency, and it is cost-effective because sophisticated metal punch heads are not needed.

BRIEF DESCRIPTION OF THE SEVERAL VIEWS OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 2:
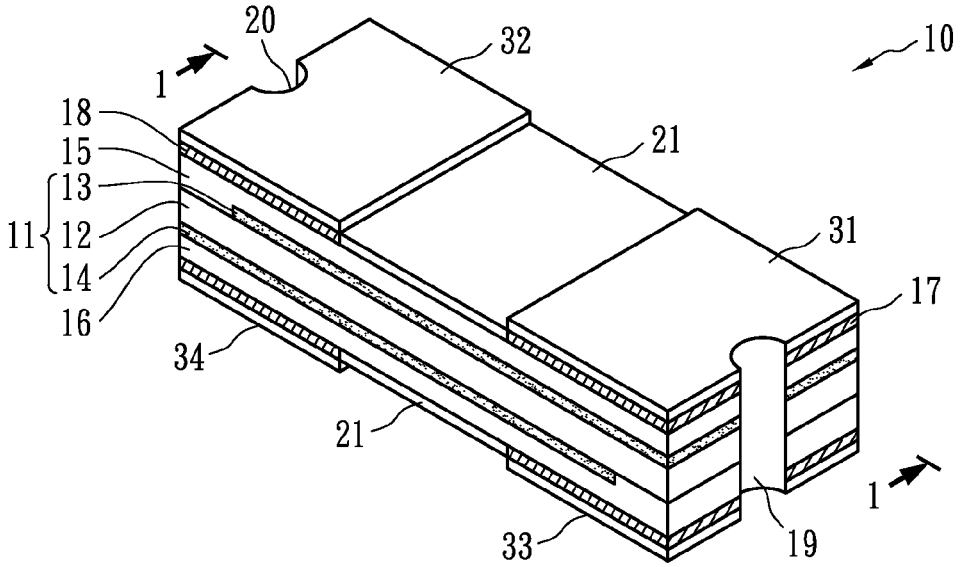
FIG. 2 shows an over-current protection device in accordance with a first embodiment of the present application.
Figure 3:
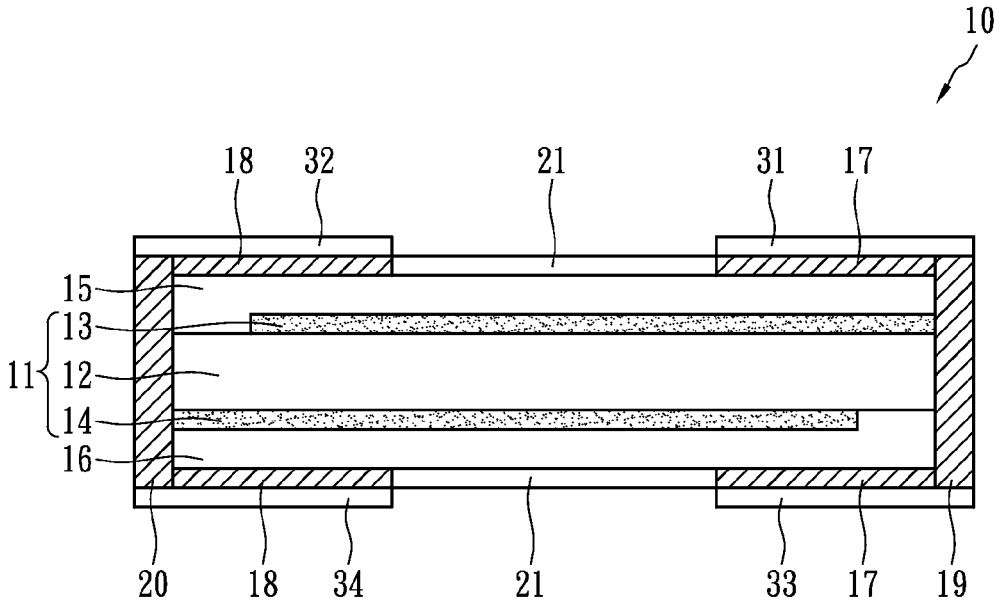
FIG. 3 shows a cross-sectional view along line 1-1 in FIG. 2.

FIG. 2 shows an over-current protection device 10 in accordance with a first embodiment of the present application, and FIG. 3 is a cross-sectional view along line 1-1 in FIG. 2. In a structural aspect, the over-current protection device 10 is a strip-like structure having an upper surface, a lower surface and four lateral planar surfaces connecting the upper and lower surfaces. The over-current protection device 10 comprises a PTC device 11, a first electrode 17, a second electrode 18, insulating layers 15 and 16, a first conductive connecting member 19, a second conductive connecting member 20 and welding metal plates 31, 32, 33 and 34. The PTC device comprises a first conductive layer 13, a second conductive layer 14 and a PTC polymeric material layer 12. The PTC polymeric material layer 12 is laminated between the first and second conductive layers 13 and 14. The PC polymeric material layer 12, the first conductive layer 13 and the second conductive layer 14 commonly extend along a first direction (horizontal direction) to form a laminated structure. The first electrode 17 electrically connects to the first conductive layer 13. The second electrode 18 electrically connects to the second conductive layer 14, and is separated from the first electrode 17. The welding metal plates 31 and 33 are formed on the upper surface and lower surface of the device 10, respectively, and connect to the first electrode 17. The welding metal plates 32 and 34 are formed on the upper surface and lower surface of the device 10, respectively, and connect to the second electrode 18. More specifically, the welding metal plates 31 and 33 are formed at an end of the strip-like structure, and the welding metal plates 32 and 34 are formed at another end of the strip-like structure, it should be noted that each of the welding metal plates 31, 32, 33 and 34 has a thickness sufficient to be withstand large current and high heat in spot-welding process without significant resultant damage to the polymeric material of the PTC device 11. The welding metal plates 31, 32, 13 and 34 may comprise nickel or the alloy thereof, and the thickness is in the range of 0.1 mm to 1 mm, and may be 0.3 mm or 0.5 mm in particular.

The PTC polymeric material layer 12 comprises crystalline polymer and conductive filler and exhibits PTC behavior. The crystalline polymer comprises polyethylene, polypropylene, polyvinyl fluoride, mixture or copolymer thereof. The conductive filler may comprise metal filler, carbon-containing filler, metal oxide filler, metal carbide filler, or mixture, solid solution, or core-shell thereof.

More specifically, the upper surface and lower surface of the PTC polymeric material layer 12 are provided with the first conductive layer 13 and the second conductive layer 14. The first conductive layer 13 and the second conductive layer 14 extend to two opposite ends of the polymeric material layer 12, respectively. The conductive layers 13 and 14 can be made from a planar metal plate in which notches at the two ends of the strip-like structure are formed by laser trimming, chemical etching or mechanical machining. The conductive layers 13 and 14 can be made of nickel, copper, zinc, silver, gold, the alloy thereof or a multilayer containing the above materials. In addition, the notches may be of rectangular, semi-circular, triangular or irregular shape or figure. The insulating layers 15, 16, the PTC device 11, an upper metal foil and a lower metal foil are hot-pressed, and then the metal foils are etched to form a first electrode 17 and a second electrode 18. In other words, the insulating layer 15 is formed on the first conductive layer 13, and the insulating layer 16 is formed on the second conductive layer 14. In this embodiment, the first electrode 17 comprises a pair of electrode layers disposed on the insulating layers 15 and 16 and the second electrode 18 comprises a pair of electrode layers disposed on the insulating layers 15 and 16 as well.

The insulating layers 15 and 16 may use epoxy resin containing fiber glass such as prepreg (FR-4). The insulating layers 15 and 16 can protect the polymeric material in the PTC polymeric material layer 12 when the over-current protection device 10 undergoes spot-welding. In an embodiment, the insulting layers 15 and 16 may further comprise heat conductive filler, such as zirconium nitride, boron nitride, aluminum nitride, silicon nitride, aluminum oxide, magnesium oxide, zinc oxide or titanium oxide. The insulating layer 15 or 16 may have a thickness up to 0.2 mm, or may be 0.1 or 0.06 mm in consideration of the insulating and strength requirements, the thickness of the insulating layer 15 or 16 has to be equal to or greater than 0.03 mm.

The electrode 17 or 18 may be a foil comprising nickel, copper, aluminum, lead, tin, silver, gold or alloy thereof, or a nickel-plated copper foil, tin-plated copper foil or tin-plated stainless steel.

In this embodiment the pair of electrode layers of the first electrode 17 on the insulating layers 15 and 16 are connected through a first conductive connecting member 19, and the pair of electrode layers of the second electrode 18 on the insulating layers 15 and 16 are connected through a second conductive connecting member 20. More specifically, the first conductive connecting member 19 extends along a second direction (vertical direction) perpendicular to the first direction to electrically connect the first electrode 17 and the first conductive layer 13, and the first conductive connecting member 19 is separated from the second conductive layer 14. The second conductive connecting member 20 extends along the second direction to electrically connect the second electrode 18 and the second conductive layer 14, and the second conductive connecting member 20 is separated from the first conductive layer 13. The first conductive connecting member 19 is disposed on a lateral surface at an end of the device 10, and the second conductive connecting member 20 is disposed on a lateral surface at another end. The insulating layers 15 and 16 are disposed between the first electrode 17 and the second electrode 18, and also disposed between the electrodes 17, 18 and conductive layers 13, 14 for insulation.

The conductive connecting members 19 and 20 of semi-circular conductive through holes are exemplified herein. The sidewall of the semi-circular hole may be plated with a conductive metal layer such as copper or gold by electroless plating or electroplating. In addition to semi-circular shape, the cross section of the hole may be of circular shape, quadrantal shape, arc shape, square shape, diamond shape, rectangular shape, triangular shape or polygon shape. Moreover, the upper and lower parts of each of the electrodes 17 and 18 may be connected through full lateral surfaces plated with conductive films. In an embodiment, the first electrode 7 is separated from the second electrode IS by gaps on which insulative solder masks 21 may be formed thereon. In this embodiment, the solder masks 21 are of rectangular shapes; nevertheless others like semicircular, arc, triangular, or irregular shapes and figures may be used also.

It may not be needed that the over-current protection device 10 contains four welding metal plates. For example, if the device 10 is welded by using the upper welding metal plates 31 and 32, the lower welding metal plates 33 and 34 can be omitted. Alternatively, the device 10 may be equipped with the welding metal plates 31 and 34, or welding metal plates 32 and 33 only to meet the requirements of various welding positions. Nevertheless, it s advantageous that the over-current protection device 10 in FIGS. 2 and 3 needs not consider the orientation of the device for welding.

Figure 1:
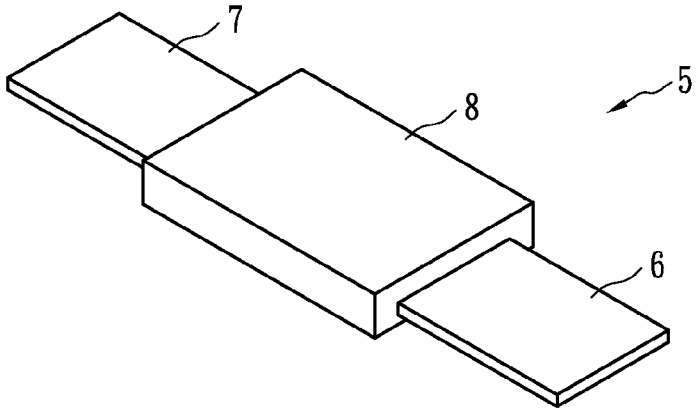
FIG. 1 (Prior Art)
FIG. 1 shows a known over-current breaker.
Figure 4:
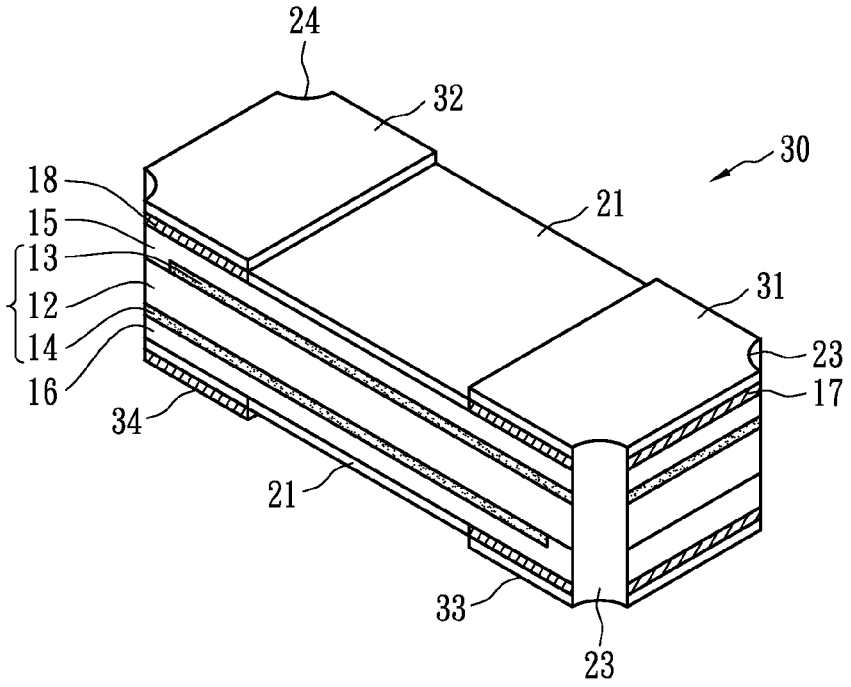
FIG. 4 shows an overcurrent protection device in accordance with a second embodiment of the present application.

FIG. 4 shows an over-current protection device 30 in accordance with a second embodiment of the present application. The device 30 is similar to the device 10 shown in FIG. 1; however, the electrode 17 and the first conductive layer 13 are connected through the conductive connecting members 23 at two corners at an end, and the electrode 18 and the second conductive layer 14 are connected through the conductive connecting members 24 at two corners at another end. In other words, the conductive connecting members 23 are formed at two corners each defined by two adjacent lateral surfaces, and the conductive connecting members 24 are formed at another two corners each defined by two adjacent lateral surfaces. The side view of the device 30 is similar to the device 10 as shown in FIG. 3.

Figure 5:
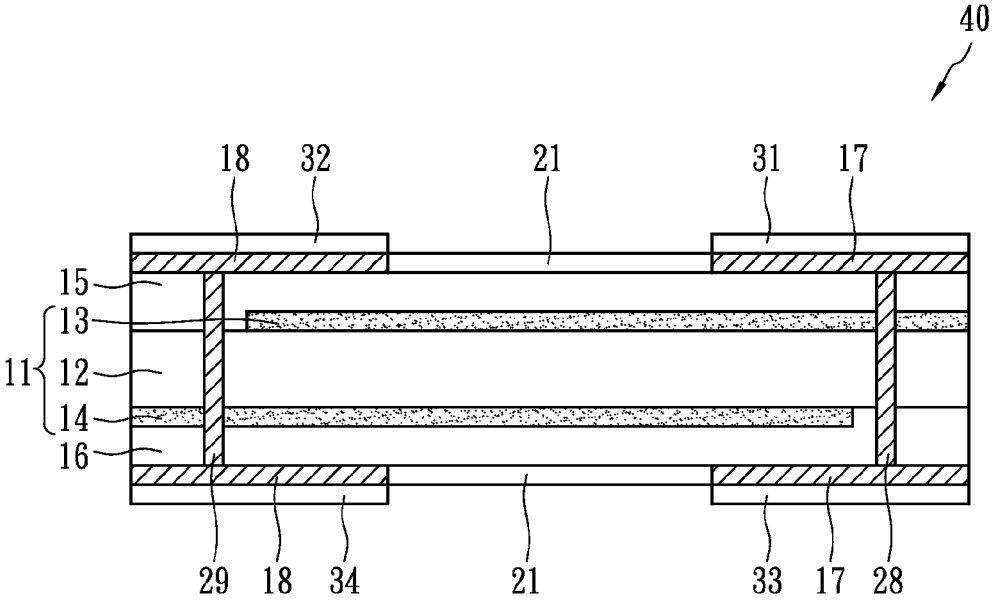
FIG. 5 shows an over-current protection device in accordance with a third embodiment of the present application.

FIG. 5 shows the side view of an over-current protection device 40 in accordance with a third embodiment of the present application. The device 40 is similar to the device 10, but conductive connecting members 28 and 29 do not form on the lateral surfaces at the ends of the device 40. The conductive connecting member 28 is an inner plated conductive through hole or post connecting to the upper and lower layers of the electrode 17 and the first conductive layer 13, and the conductive connecting member 28 is separated from the second conductive layer 14. Likewise, the conductive connecting member 29 is an inner plated conductive through hole or post connecting to the upper and lower layers of the electrode 18 and the second conductive layer 14, and the conductive connecting member 29 is separated from the first conductive layer 13. In an exemplified embodiment, if the conductive layer 13 extends to the left end of the device 40, a hole of the conductive layer 13, which surrounds the conductive connecting member 29, is made to separate the conductive layer 13 from the conductive connecting member 29.

Figure 6:
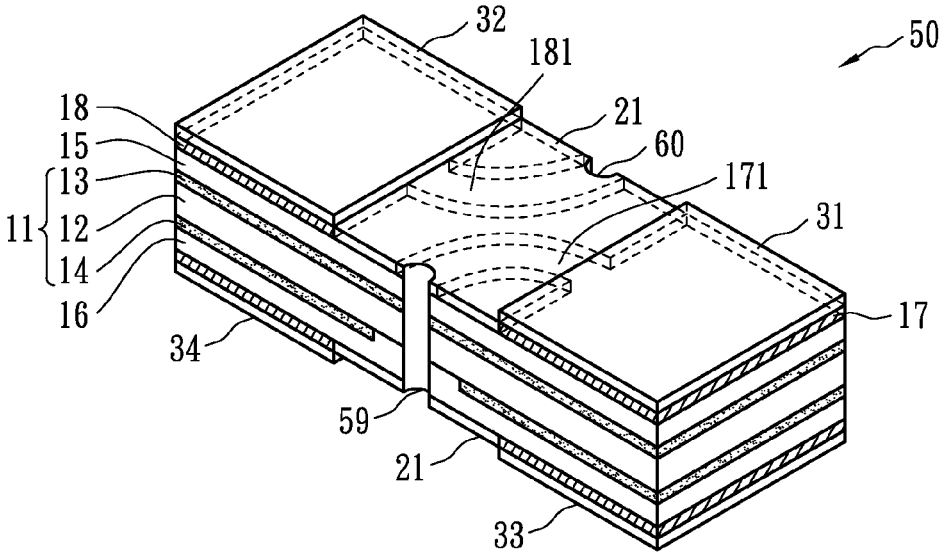
FIG. 6 shows an over-current protection device in accordance with a fourth embodiment of the present application.

FIG. 6 shows an over-current protection device 50 in accordance with a fourth embodiment of the present application. Like the device shown in FIG. 2, but the conductive connecting members 59 and 60 are formed on other two opposite lateral surfaces. The first electrode 17 has an extension portion 171 connecting to the conductive connecting member 59 through which the first electrode 17 electrically connects to the first conductive layer 13. The second electrode 18 has an extension portion 181 connecting to the conductive connecting member 60 through which the first electrode 18 electrically connects to the second conductive layer 14.

The aforementioned embodiments can be modified to contain two or more PTC devices 11 in parallel connection to form a multi-layer and parallel connection device, which is applicable for large current and low resistance applications. The over-current protection device whose structure is like an SMD device can be made through printed circuit board (PCB) process. Many devices with the same size of traditional circuit breaker are formed on a substrate, and two welding metal plates are formed on the device for the use in subsequent welding. The substrate is then cut to form plural devices.

The devices of the second embodiment (FIG. 4, Design 1), the third embodiment (FIG. 5, Designs 2 and 3) and the fourth embodiment (FIG. 6, Design 4) undergo various tests to understand the characteristics thereof. Designs 2 and 3 correspond to the structure shown in FIG. 5, but Design 2 has a narrower width. In addition to a single PTC device, the designs also contain two stacked PTC devices in parallel connection. The dimensions of the Designs and a traditional breaker are listed in Table 1. The lengths and widths of the Designs match those of the traditional breaker, and the thickness of the Designs, which may contain one or two PTC devices, are less than that of the traditional breaker. Therefore, the footprint of the Designs complies with a traditional device, and the Designs are thinner to be easily arranged. In general, the over-current protection device for testing has a length about 12 mm or between 10-14 mm, a width between 2.3-3.5 mm and a thickness between 0.5-2 mm. The thickness of the device may be 0.8 mm, 1 mm, 1.2 mm or 1.5 mm.

TABLE 1

| | Design 1 | Design 2 | Design 3 | Design 4 | Traditional breaker |
|---|---|---|---|---|---|
| Length (mm) | 12.17 | 12.14 | 12.11 | 12.12 | 11.74 |
| Width (mm) | 3.11 | 2.57 | 3.08 | 3.11 | 3.42 |
| Thickness (mm) (Single PTC device) | 0.52 | 0.56 | 0.52 | 0.53 | 1.2 |
| Thickness (mm) Two PTC devices) | 1.01 | 0.96 | 0.98 | 0.96 | — |

Three compositions are tested. Composition 1 contains a PTC material having high melting temperature crystalline polymer and titanium carbide (TiC); Composition 2 contains a PTC material having low melting temperature crystalline polymer and tungsten carbide (WC); Composition 3 contains a PTC material having low melting temperature crystalline polymer and titanium carbide. The titanium carbide and tungsten carbide serving as conductive fillers are dispersed in the crystalline polymer. The high melting temperature crystalline polymer has a melting temperature in a range of 120-140° C., such as high density polyethylene (HDDPE) and polyvinylidene fluoride (PVDF). The low melting temperature crystalline polymer has a melting temperature in a range of 70-105° C., such as low density polyethylene (LDPE). In addition to the titanium carbide and tungsten carbide, other conductive ceramic having a resistivity less than 500 μΩ-cm, such as vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride ($VB_2$), zirconium bon de niobium boride ($NrB_2$), molybdenurn boride ($MoB_2$), hafnium boride ($HfB_2$) biannual nitride (TiN) or zirconium nitride (ZrN) may be used.

Table 2 shows initial resistance (Ri) of the over-current protection device and the resistance (RI) measured one hour later after the device trips once and returns to room temperature. Ri and RI of all the Compositions and Designs are less than 8 mΩ, or less than 6 mΩ in particular. Designs 1, 2 and 3 are less than 4 mΩ. It is obvious that the over-current protection devices meet low-resistance requirement for breakers.

TABLE 2

(Resistance; mΩ)

| | Composition | | | | | | | | |
|---|---|---|---|---|---|---|---|---|---|
| | 1 | | | | 2 | 3 | | | |
| Design | 1 | 2 | 3 | 4 | 1 | 1 | 2 | 3 | 4 |
| Ri (single PTC device) | 3.3 | 3.5 | 3.2 | 5.2 | 3.4 | 3.5 | 2.2 | 3.4 | 5.5 |
| Ri (two PTC devices) | — | — | — | — | 1.9 | 2.2 | 2.7 | 2.4 | 4.5 |
| R1 (single PTC device) | 3 | 2.9 | 2.7 | 4.8 | 3.9 | 3.4 | 2 | 3 | 4 |
| R1 (two PTC devices) | — | — | — | — | 2.1 | 2 | 2.3 | 2.1 | 4.2 |

Table 3 shows the hold currents of the over-current protection devices at ambient temperatures of 23° C. and 60° C., i.e., the maximum current of the device without trip. It can be seen from Table 3 that the hold current of all the devices are equal to or larger than 3.6 A. More specifically, the devices of Composition 1 and Composition 3 have hold currents equal to or larger than 4 A, or 4.6 A in particular regardless of 23° C. or 60° C.

TABLE 3

(Hold current; amperes)

| | Composition | | | | | | | | |
|---|---|---|---|---|---|---|---|---|---|
| | 1 | | | | 2 | 3 | | | |
| Design | 1 | 2 | 3 | 4 | 1 | 1 | 2 | 3 | 4 |
| 23° C. (Single PTC device) | 7.2 | 7.5 | 8.1 | 6.8 | 5.3 | 6.6 | 6.1 | 6.2 | 5.6 |
| 23° C. (Two PTC devices) | — | — | — | — | 6.6 | 8.7 | 7.4 | 7.8 | 6.8 |
| 60° C. (Single PTC device) | 7 | 6.3 | 7 | 5.3 | 3.6 | 6.2 | 5.3 | 5.3 | 5.1 |
| 60° C. (Two PTC devices) | — | — | — | — | 4.6 | 7.7 | 6.7 | 6 | 6.6 |

Table 4 shows the thermal cut off (TCO) temperatures of the over-current protection devices undergoing 2 amperes and 4.6 amperes. That is, when the device heat up to the temperature, the current will be cut off. Generally, it is advantageous to have lower TCO temperature to ensure that the current can decrease instantly as temperature increases. Table 4 shows that the TCO temperatures are less than 120° C., and the TCO temperatures of Composition 2 and Design 1 are equal to or less than 90° C., or equal to or less than 80° C. in particular.

TABLE 4

(TCO temperature; ° C.)

| | Composition | | | | | | | | |
|---|---|---|---|---|---|---|---|---|---|
| | 1 | | | | 2 | 3 | | | |
| Design | 1 | 2 | 3 | 4 | 1 | 1 | 2 | 3 | 4 |
| 2 A (Single PTC device) | 118 | 116 | 117 | 113 | 77 | 106 | 112 | 108 | 97 |
| 2 A (Two PTC devices) | — | — | — | — | 80 | 109 | 113 | 109 | 105 |
| 4.6 A (Single PTC device) | 102 | 99 | 98 | 93 | 59 | 87 | 95 | 96 | 69 |
| 4.6 A (Two PTC devices) | — | — | — | — | 69 | 86 | 98 | 91 | 86 |

Table 5 shows time-to-trip data for the devices of various Compositions and Designs, in which 8 amperes is applied to the devices. The time-to-trip is preferably less than 60 seconds. The time-to-trip data for all the devices is less than 80 seconds to ensure the devices being able to activate timely.

TABLE 5

| (Time-to-trip; seconds) | | | | | |
|---|---|---|---|---|---|
| | Composition | | | | |
| | 2 | 3 | | | |
| Design | 1 | 1 | 2 | 3 | 4 |
| 8 A (single PTC device) | 11 | 38 | 18 | 44 | 18 |

It can be seen from Tables 2 to 5 that the device of the present application have low resistance (e.g., <8 mΩ), high hold current (e.g., >4 A at 60° C.), low TCO temperature (e.g., ≤90° C. at 2 A) and short time-to-trip (e.g., sec at <60 sec at 8 A), those characteristics meet the criteria of breakers. Therefore, the over-current protection device is qualified and is able to replace the traditional breaker. Moreover, the over-current protection devices can be made by printed circuit board (PCB) process, so they are cost-effective in mass production.

Figure 7:
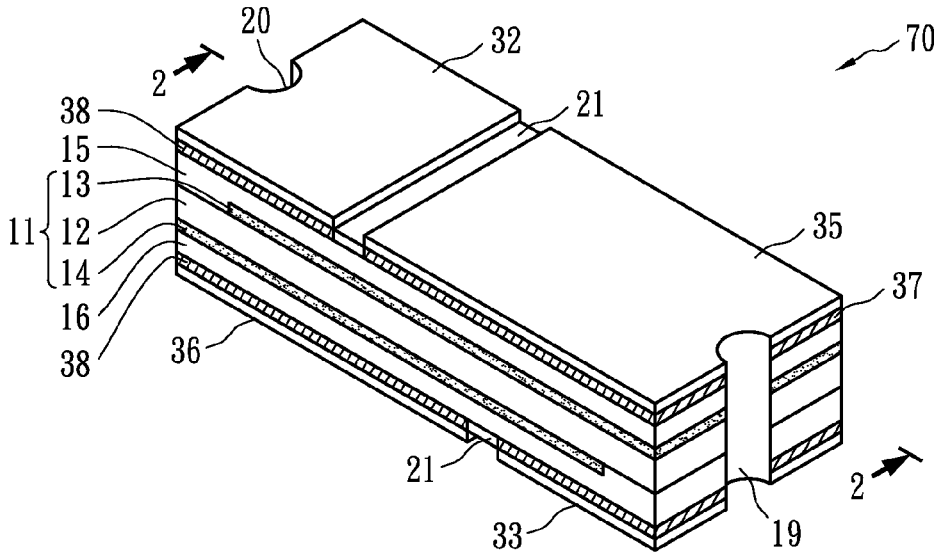
FIG. 7 shows an over-current protection device in accordance with a fish embodiment of the present application.
Figure 8:
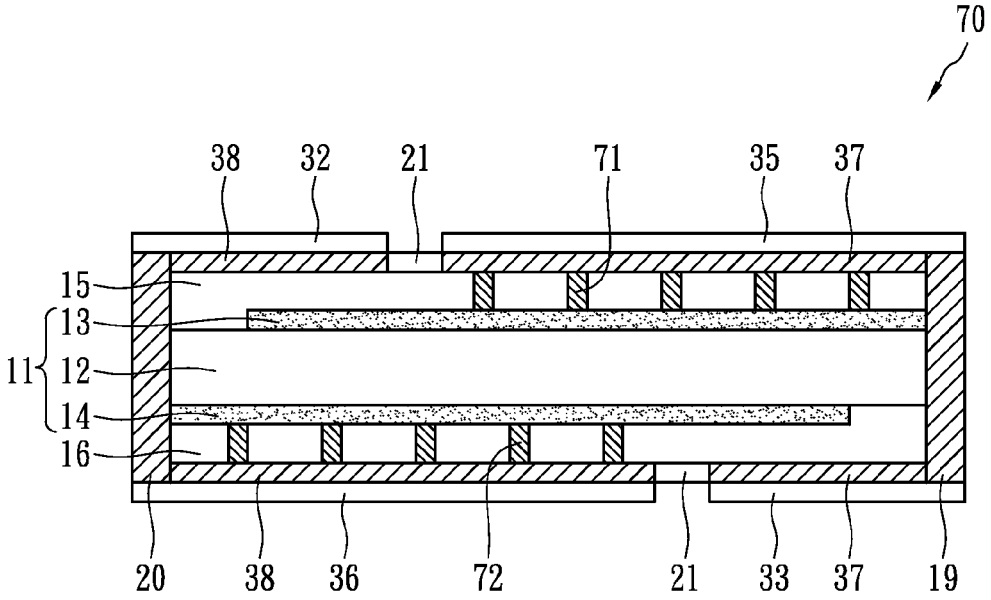
FIG. 8 shows a cross-sectional view along line 2-2 in FIG. 7.

FIG. 7 shows an over-current protection device 70 in accordance with a fifth embodiment of the present application. FIG. 8 shows a cross-sectional view along line 2-2 in FIG. 7. Compared to the device 10 of the first embodiment the upper part of the first electrode 37 and the welding metal plate 3 of the over-current protection device 70 are commonly elongated, and heat-conductive metal members 71 connect to the first electrode 37 and the conductive layer 13. The heat-conductive metal members 71 provide not only electrical conduction but also thermal conduction for the sake of heat dissipation, thereby increasing the saint, of hold Current. Likewise, the lower part of the second electrode 38 and the welding metal plate 36 are commonly elongated, and heat-conductive metal members 72 connect to the second electrode 38 and the conductive layer 14 for providing electrical and thermal conduction therebetween. More specifically, the welding metal plates 35 and 36 are in physical contact with the electrodes 37 and 38, respectively. The welding metal plate 35 and the electrode 37 are commonly elongated to exceed half the length of the device 70, and the welding metal plate 36 and the electrode 38 are commonly elongated to exceed half the length of the device 70. More specifically, the heat-conductive metal members 71 vertically connect to the first electrode 37 and the conductive layer 13, and the heat-conductive metal members 72 vertically connect to the second electrode 38 and the conductive layer 14.

Figure 9:
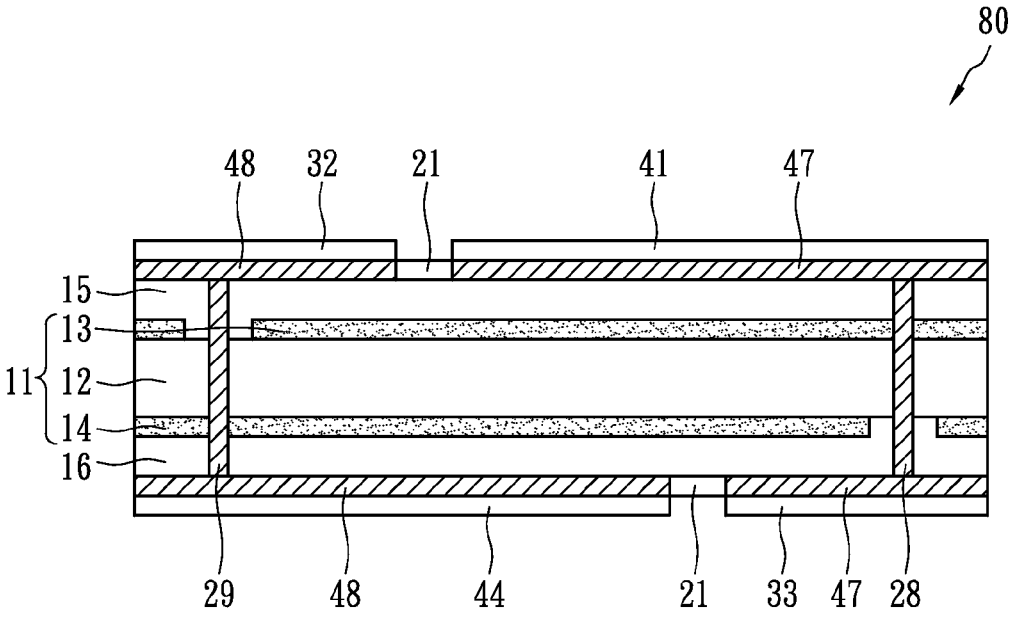
FIG. 9 shows an over-current protection device in accordance with a sixth embodiment of the present application.

FIG. 9 shows an over-current protection device 80 in accordance with a sixth embodiment of the present application. Unlike the device 40 shown in FIG. 5, the upper pan of the first electrode 47 and the welding metal plate 41 of the device 80 are commonly elongated to increase heat dissipation efficiency. Likewise, the lower part of the second electrode 48 and the welding metal plate 44 are commonly elongated to increase heat dissipation efficiency. In this embodiment, the conductive connecting members 29 and 28 go through the conductive layers 13 and 14 in which holes are formed for separation between the conductive connecting member 29 and the conductive layer 13 and between the conductive connecting member 28 and the conductive layer 14.

Figure 10A:
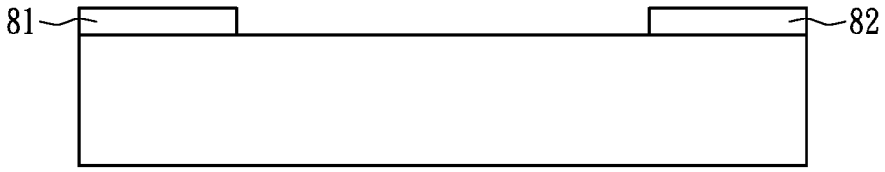
FIGS. 10A to 10D show arrangements of welding metal plates of the over-current protection device in accordance with the present application.
Figure 10B:
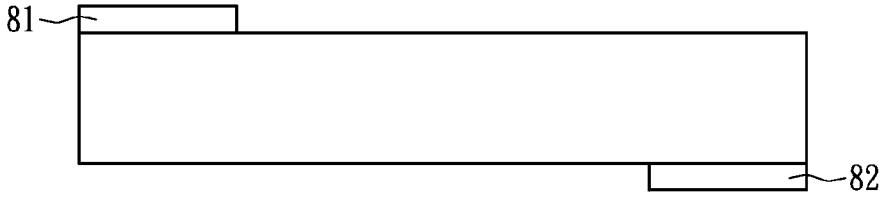
Figure 10C:
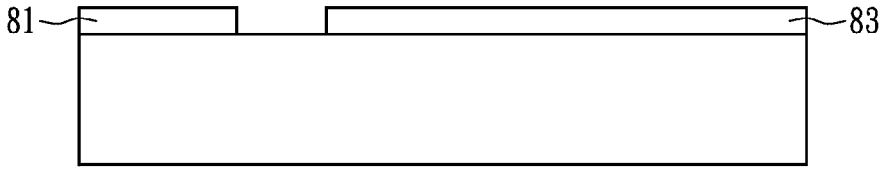
Figure 10D:
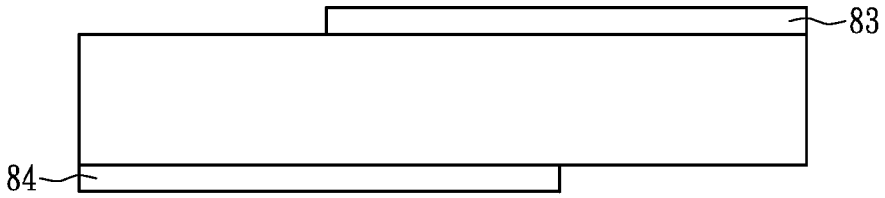

In addition to the above embodiments, welding metal plates may be placed at different positions as desired. In FIG. 10A, welding metal plates 81 and 82 are disposed at two ends of a side of the device. In FIG. 1013, welding metal plates 81 and 82 are disposed at opposite ends of two sides of the device. In FIG. 10C, the welding metal plate S and longer welding metal plate 83 are disposed at two ends of a side of the device. In FIG. 10D, longer welding metal plates 83 and 84 are disposed at opposite ends of two sides of the device.

Figure 11A:
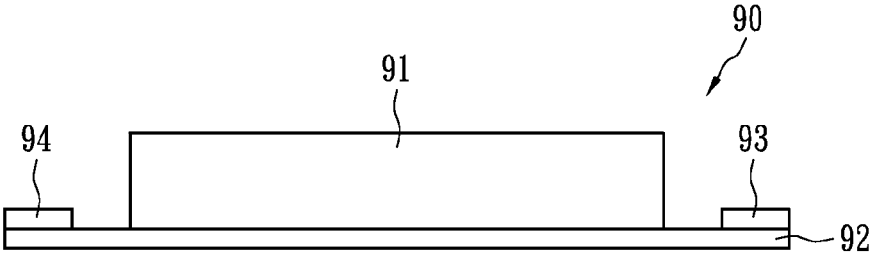
FIGS. 11A and 11B shows an over-current protection device in accordance with a seventh embodiment of the present application.
Figure 11B:
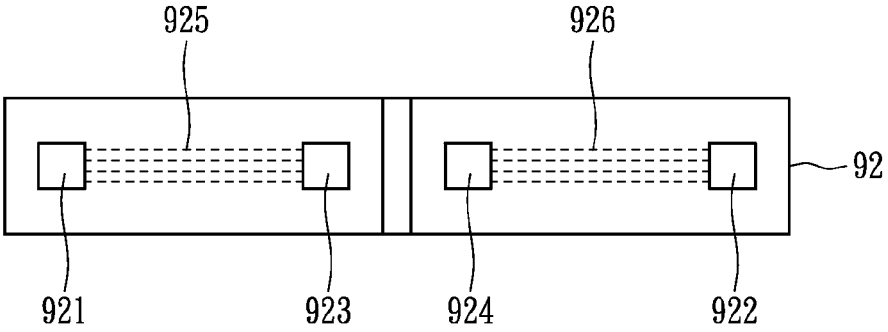

In addition to being disposed on the surfaces of the device, the welding metal plates may be alternatively disposed on a substrate as mentioned below. FIG. 11A shows an over-current protection device in accordance with a seventh embodiment of the present application, and FIG. 118 shows a to view of a substrate of the over-Current protection device. The over-current protection device 90 comprises a substrate 92 and a resistive device 91 disposed thereon. The resistive device 91 does not have welding metal plates. Instead, the welding metal plates 93 and 94 are disposed at two ends of a surface of the substrate 92. The substrate 92 is provided with bonding pads 921 and 922 corresponding to the welding metal plates 94 and 93 for jointing. In addition, the substrate 92 is provided with bonding pads 923 and 924 to electrically connect to the lower electrodes of resistive device 91. The bonding pads 921 and 923 are connected through copper lines 925, and the bonding pads 922 and 924 are connected through copper lines 926. The substrate 92 may be overlaid and protected by an insulating layer except the area of bonding pads 921, 922, 923 and 924 for soldering or welding. The substrate 92 may comprise epoxy resin containing fiber glass (e.g., FR-4 substrate) or flexible printed circuit (e.g., FPC substrate). In summary, the over-current protection device 90 comprises a substrate 92, a resistive device 91, a first welding metal plate 93 and a second welding Metal plate 94. The resistive device 91 may comprise the structure shown in each of the aforesaid embodiments excluding welding metal plates, which has a first electrode and a second electrode. The first welding metal plate 93 is disposed at an end of a surface of the substrate 92 and electrically connects to the first electrode of the resistive device 91. The second welding metal plate 94 is disposed at another end of the surface of the substrate 92 and electrically connects to the second electrode of the resistive device 91. The thickness of each of the first and second welding metal plates 93 and 94 is sufficient to withstand spot-welding without significant resultant damage.

Figure 12:
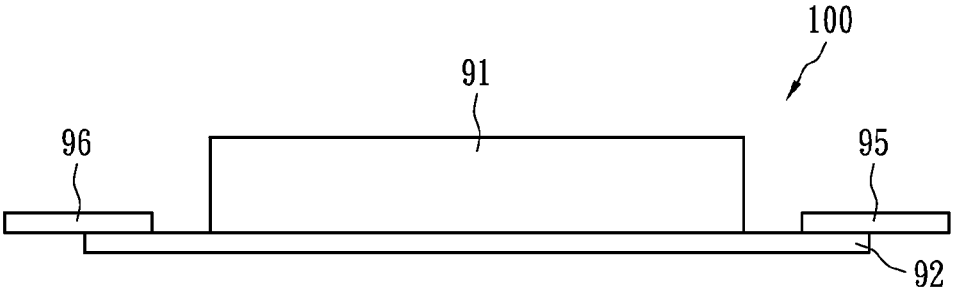
FIG. 12 shows an over-current protection device in accordance with an eighth embodiment of the present application.

FIG. 12 shows an over-current protection device in accordance with an eighth embodiment of the present application. Compared to the device shown in FIG. 11A, an over-current protection device 100 has a first welding metal plate 95 and a second welding metal plate 96 disposed at two ends of the substrate 92. Nevertheless, the welding metal plates 95 and 96 extend and protrude the substrate 92 to provide flexibility for installation.

In case of using FPC, the substrate 92 with heat dissipation function can increase hold current value of the device. Moreover, flexible FPC substrate provides flexibility for installation. The copper lines 925 and 926 of the substrate 92 can be easily made by printed circuit board (PCB) process. In contrast, the welding nickel plates need be made by molding. As a result, the use of FPC can enhance design convenience and decrease manufacturing cost.

The over-current protection device of the present application has the following advantages. (1) It can replace a traditional breaker, and is able to be subjected to spot-welding directly. (2) The manufacturing process is simple and the punch process by a precision machine is not need, and thus the production yield and efficiency can be increased. (3) Sophisticated metal punch head is not needed and therefore manufacturing cost can be decreased. (4) Welding plates such as nickel plates can be placed by not only manual disposal but also surface-mountable technology, so as to provide more efficient manufacturing. (5) The nickel plates are welded before shipping out, resistance variance caused by soldering process at customer sites can be minimized. (6) The shapes of the devices of the present application are equivalent or similar to current SMD products, all of the devices can be subjected to resistance sorting to obtain better quality control. (7) The devices can be packed in reels rather than in bulk. (8) Different from welding of axial-leaded devices, the peeling of the welding metal plates of the present application caused by extremely large torque can be avoided.

The above-described embodiments of the present invention are intended to be illustrative only. Numerous alternative embodiments may be devised by persons skilled in the art without departing from the scope of the following claims.

We claim:

1. An over-current protection device; comprising:

a substrate comprising a first bonding pad, a second bond pad, a third bonding pad and a fourth bonding pad;

a resistive device of a strip-like structure having an upper surface, a lower surface and four lateral planar surfaces, the resistive device comprising a PTC device, a first electrode and a second electrode, the PTC device comprising a first conductive layer, a second conductive layer and a PTC polymeric material layer laminated therebetween, the first electrode electrically connecting to the first conductive layer, the second electrode electrically connecting to the second conductive layer and being separated from the first electrode;

a first welding metal plate formed on the substrate at one end and electrically connected to the first electrode; and a second welding metal plate formed on the substrate at another end and electrically connected to the second electrode;

wherein the first bonding pad is configured to connect to the first welding metal plate, the second bonding pad is configured to connect to the second welding metal plate, the third bonding pad is disposed on a lower surface of the resistive device and is configured to connect to the first electrode, the fourth bonding pad is disposed on the lower surface of the resistive device and is configured to connect to the second electrode;

wherein the first and third bonding pads are electrically connected, and the second and fourth bonding pads are electrically connected;

wherein each of the first and second welding metal plates has a thickness sufficient to withstand spot-welding without significant resultant damage.

2. The over-current protection device of claim 1, wherein the substrate comprises epoxy containing fiberglass or a flexible printed circuit.

* * * * *